US006539644B1

(12) United States Patent
Araya

(10) Patent No.: US 6,539,644 B1
(45) Date of Patent: Apr. 1, 2003

(54) DRYING OF CERAMIC HONEYCOMB SUBSTRATES

(75) Inventor: Carlos R. Araya, Woodhull, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/952,171

(22) Filed: Sep. 15, 2001

(51) Int. Cl.[7] ..... F26B 3/34

(52) U.S. Cl. ..... 34/259; 34/255; 34/307; 34/310; 34/311; 34/437

(58) Field of Search ..... 34/259, 307, 309, 34/310, 311, 255, 437

(56) References Cited

U.S. PATENT DOCUMENTS 4,570,045 A * 2/1986 Jeppson ..... 219/10.55 A
5,205,991 A 4/1993 Avery et al.
5,223,188 A * 6/1993 Brundage et al. ..... 264/26
5,263,263 A * 11/1993 Gheorghiu et al. ..... 34/1 L
5,316,710 A * 5/1994 Tasaki et al. ..... 264/57
5,388,345 A * 2/1995 Brundage et al. ..... 34/256
5,488,785 A * 2/1996 Culp ..... 34/307
5,529,732 A * 6/1996 Ideguchi et al. ..... 264/57
5,979,073 A * 11/1999 Fuls et al. ..... 34/259

* cited by examiner

*Primary Examiner*—Ira S. Lazarus
*Assistant Examiner*—K. B. Rinehart
(74) *Attorney, Agent, or Firm*—Anca C. Gheorghiu

(57) ABSTRACT

A method for controlling differential shrinkage during drying of ceramic honeycomb substrates by heating the ceramic honeycomb substrate with a vapor-insulating guard disposed substantially about the ceramic honeycomb substrate.

4 Claims, 1 Drawing Sheet

DRYING OF CERAMIC HONEYCOMB SUBSTRATES

BACKGROUND OF THE INVENTION

The present invention relates to an improved method of drying ceramic honeycomb substrates such as those utilized in catalytic converter, and in particular to controlling the shrinkage during the drying process of such ceramic honeycomb substrates.

Differential or non-uniform shrinkage during the drying process of ceramic honeycomb substrates has long been a problem in the art. It is readily known, that the skin or outer portion of the ceramic honeycomb substrates dries at a faster rate than the core or interior portion. This is because at the skin, the rate of evaporation of water molecules is faster than the rate of water molecules migration from the interior portion to the outer portion of the substrate. In essence at the surface water molecules evaporate faster than they are replenished. As a result there is more shrinkage at the skin than at the core of the substrate, which in turn creates warping or distortion and leads to the development of harmful stresses which may result in cracking of the part during subsequent firing processes.

Accordingly, there is a need for a process for controlling differential shrinkage during drying in honeycomb substrates, in order to minimize the development of harmful stresses within the structure of ceramic honeycomb substrates.

SUMMARY OF THE INVENTION

The invention is directed to a method of controlling the drying shrinkage in ceramic honeycomb substrates of the type used in automotive catalytic converters. Such honeycomb bodies typically are made of cordierite and include a structure having thin interconnecting porous walls which form parallel cell channels longitudinally extending between the end faces of the structure, as disclosed in U.S. Pat. Nos. 2,884,091, 2,952,333, and 3,242,649. Honeycomb ware is typically manufactured by extruding or fabricating ceramic material into logs, followed by cutting, drying and firing.

The method of the present invention which provides the improved drying of green or wet honeycomb substrates by controlling the drying shrinkage comprises drying the honeycomb substrate with a vapor-insulating guard substantially disposed about the outer surface of green honeycomb substrate. The vapor-insulating guard acts to retard the rate of evaporation of water molecules at the skin or outer portion, thereby effecting an equilibrium between the rate of evaporation of water molecules at the skin and the rate of migration of the water molecules from the core or inner portion of the substrate. In order to maintain this evaporation-migration equilibrium the vapor-insulating guard must be disposed about the green honeycomb substrate throughout the drying process.

The vapor-insulating guard can be made of any material that acts as a barrier to the evaporation of water molecules at the skin or outer portion of the ceramic honeycomb substrate. Preferably, the vapor-insulating guard is made of plastic, and more preferably, a thin plastic sheet such as commercially available SaranWrap™ plastic film. Other suitable choices include Mylar™ plastic sheets, and plastic tubing made of for example Lexan™.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Figure 1:
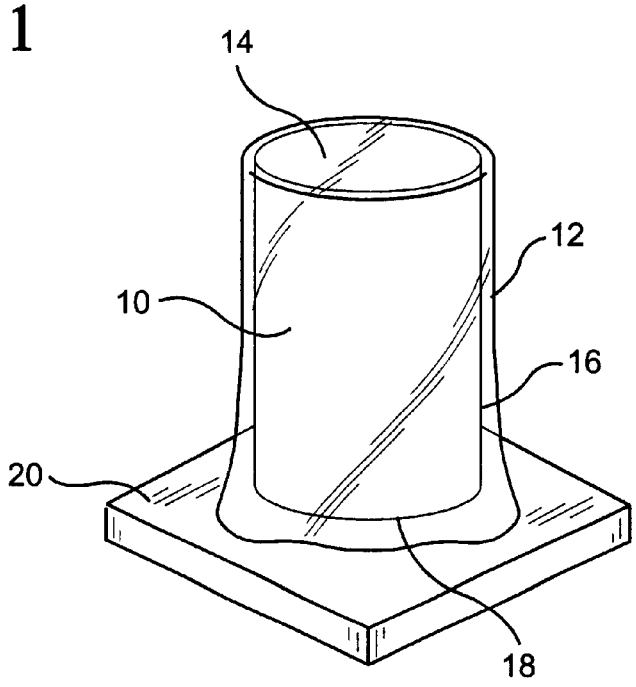
FIG. 1 is a perspective view of a honeycomb substrate vertically positioned for drying, with the vapor-insulating guard disposed about a first end and the skin or outer surface; and, FIG. 2 is a perspective view of a honeycomb substrate horizontally positioned for drying, with the vapor-insulating guard disposed about both ends of the substrate and a portion of the outer surface.

Referring now to FIG. 1 therein illustrated is a green ceramic or wet honeycomb substrate 10 and vapor-insulating guard 12 comprising a thin plastic film. Vapor-insulating guard 12 is substantially disposed about substrate 10, particularly in this embodiment about first end 14 and skin or outer portion 16. Substrate 10 is positioned with second end 18 in setter plate 20, to be dried vertically. Setter plate 20 is of the type known in the art.

Figure 2:
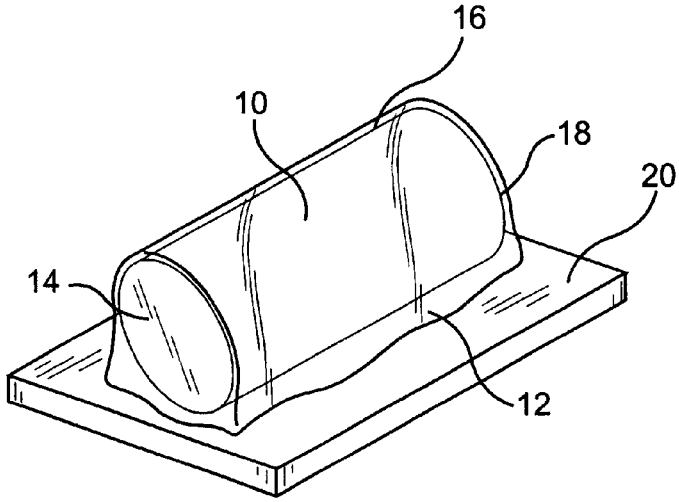

The position of the ceramic honeycomb substrate is not important to the present invention and as such another embodiment is presented in FIG. 2 in which it is illustrated substrate 10 in a horizontal position on setter plate 20. Vapor-insulating guard 12 is substantially disposed about first end 14, second end 18 and a portion of skin or outer surface 16.

The drying of the green honeycomb substrates is preferably accomplished through the use of dielectric heating, either microwave or radio frequency (RF) in which energy is released in a non-conductive medium through dielectric hysteresis, as disclosed in U.S. Pat. Nos. 5,263,263 and 5,406,058.

The vapor-insulating guard, which is positioned about the ceramic honeycomb substrate before the drying process and thereafter removed prior to the subsequent cutting and firing cycle, acts to retard the rate of evaporation of water molecules at a skin or outer surface of the ceramic honeycomb substrate to effect an equilibrium between the rate of evaporation of water molecules at the skin and the rate of migration of the water molecules from the core or inner portion of the substrate.

The advantage of the present invention is a uniform and complete drying of green ceramic or wet honeycomb substrates without distorting, warping or cracking the substrates, thus minimizing the development of harmful stresses within the structure.

It is claimed:

1. A method of drying green ceramic honeycomb substrate having a first end and a second end, and thin interconnecting porous walls which form parallel cell channels longitudinally extending between the first and second ends, the improvement comprising:

a) drying the green ceramic honeycomb substrate with a vapor-insulating guard substantially covering the ceramic honeycomb substrate to retard the rate of evaporation of water molecules at a skin or outer surface of the ceramic honeycomb substrate and to effect an equilibrium between the rate of evaporation of water molecules at the skin and the rate of migration of the water molecules from a core or inner portion of the substrate; and, b) removing the vapor-insulating guard after completion of the drying cycle.

2. The method of claim 1 wherein the vapor-insulating guard is a thin film of plastic.

3. The method of claim 1 wherein drying step is performed by dielectric heating.

4. The method of claim 1 wherein the drying step is performed by microwave heating.

* * * * *